US008608586B2

(12) United States Patent
Parente et al.

(10) Patent No.: US 8,608,586 B2
(45) Date of Patent: Dec. 17, 2013

(54) GOLF PUTTER

(76) Inventors: Richard E. Parente, San Diego, CA (US); Gene Parente, San Diego, CA (US); Steven Sacks, San Diego, CA (US)

( * ) Notice: Subject to any disclaimer, the term of this patent is extended or adjusted under 35 U.S.C. 154(b) by 287 days.

(21) Appl. No.: 13/224,309

(22) Filed: Sep. 1, 2011

(65) Prior Publication Data

US 2013/0059675 A1 Mar. 7, 2013

(51) Int. Cl.
*A63B 53/00* (2006.01)

(52) U.S. Cl.
USPC ..... 473/292

(58) Field of Classification Search
USPC ..... 473/292
See application file for complete search history.

(56) References Cited

U.S. PATENT DOCUMENTS

| | | | | |
|---|---|---|---|---|
| 3,497,220 | A | | 2/1970 | Scott |
| 3,623,724 | A | | 11/1971 | Lande |
| 3,897,066 | A | | 7/1975 | Belmont |
| 3,954,265 | A | | 5/1976 | Taylor |
| 3,979,122 | A | | 9/1976 | Belmont |
| 4,043,563 | A | | 8/1977 | Churchward |
| 4,128,244 | A | | 12/1978 | Duclos |
| 4,157,181 | A | | 6/1979 | Cecka |
| 4,438,931 | A | | 3/1984 | Motomiya |
| 4,461,479 | A | | 7/1984 | Mitchell |
| 4,607,846 | A | | 8/1986 | Perkins |
| 4,650,191 | A | | 3/1987 | Mills et al. |
| 5,004,236 | A | | 4/1991 | Kameshima |
| 5,152,527 | A | | 10/1992 | Mather et al. |
| 5,190,291 | A | * | 3/1993 | Melvin ..... 473/232 |
| 5,364,102 | A | | 11/1994 | Appledorn |
| 5,451,058 | A | | 9/1995 | Price et al. |
| 5,482,279 | A | | 1/1996 | Antonious |
| 5,494,288 | A | | 2/1996 | Jimenez et al. |
| 5,554,078 | A | * | 9/1996 | Hannon et al. ..... 473/292 |
| 5,569,097 | A | * | 10/1996 | Veux et al. ..... 473/292 |
| 5,632,691 | A | * | 5/1997 | Hannon et al. ..... 473/292 |
| 5,653,644 | A | | 8/1997 | Jaeckel |
| 5,695,408 | A | | 12/1997 | DeLaCruz et al. |
| 5,755,624 | A | | 5/1998 | Helmstetter |
| 5,776,008 | A | | 7/1998 | Lundberg |
| 5,788,585 | A | | 8/1998 | Jackson |

(Continued)

FOREIGN PATENT DOCUMENTS

| | | |
|---|---|---|
| WO | WO9726954 | 7/1997 |
| WO | WO9728852 | 8/1997 |

*Primary Examiner* — Stephen L. Blau
(74) *Attorney, Agent, or Firm* — Steven M. Greenberg, Esq.; Kara A. Brotman, Esq.; Carey, Rodriquez, Greenberg & O'Keefe, LLP

(57) ABSTRACT

A golf club with a club head comprising a body defining a volume, a shaft coupled to the club head, and a balance point established above the sole and no further away from the sole than five inches is provided. A method for creating a club head with enhanced balance point placement can also be provided. The method can include, in a golf club formed from a club head coupled to a shaft, moving a balance point from a position between no less than seven inches and no more than eighteen inches measured from the sole along a longitudinal axis of the shaft between a butt of the shaft and a sole of the club head to a position no further away from the sole than five inches measured from the sole along a longitudinal axis of the shaft.

5 Claims, 5 Drawing Sheets

(56) References Cited

U.S. PATENT DOCUMENTS

| | | | | |
|---|---|---|---|---|
| 5,947,840 | A | 9/1999 | Ryan | |
| 6,001,024 | A | 12/1999 | Van Alen, II et al. | |
| 6,015,354 | A | 1/2000 | Ahn et al. | |
| 6,017,279 | A | 1/2000 | Sumitomo | |
| 6,033,320 | A | 3/2000 | Bamberger | |
| 6,190,267 | B1 | 2/2001 | Marlowe et al. | |
| 6,290,608 | B2 | 9/2001 | Gates | |
| 6,290,609 | B1 | 9/2001 | Takeda | |
| 6,352,482 | B1 | 3/2002 | Jacobson et al. | |
| 6,379,265 | B1 | 4/2002 | Hirakawa et al. | |
| 6,409,612 | B1 | 6/2002 | Evans et al. | |
| 6,506,128 | B1 | 1/2003 | Bloom, Jr. | |
| 6,514,154 | B1 | 2/2003 | Finn | |
| 6,527,649 | B1 | 3/2003 | Neher et al. | |
| 6,739,983 | B2 | 5/2004 | Helmstetter et al. | |
| 6,863,623 | B2 | 3/2005 | Oyama | |
| 6,923,734 | B2 | 8/2005 | Meyer | |
| 6,988,956 | B2 | 1/2006 | Cover et al. | |
| 6,991,558 | B2 | 1/2006 | Beach et al. | |
| 7,189,169 | B2 | 3/2007 | Billings | |
| 7,410,426 | B2 | 8/2008 | Willett et al. | |
| 7,452,285 | B2 | 11/2008 | Chao et al. | |
| 7,828,672 | B2 | 11/2010 | Billings | |
| 8,491,410 | B2 * | 7/2013 | Kato | 473/319 |
| 2002/0173377 | A1 * | 11/2002 | Sindelar | 473/340 |
| 2003/0162606 | A1 * | 8/2003 | Schikner | 473/319 |
| 2006/0122005 | A1 * | 6/2006 | Nilsson et al. | 473/340 |
| 2007/0207876 | A1 * | 9/2007 | Shende | 473/340 |
| 2008/0085780 | A1 | 4/2008 | Evans | |
| 2010/0041492 | A1 | 2/2010 | Rice et al. | |
| 2010/0248856 | A1 | 9/2010 | Hunter | |
| 2010/0317457 | A1 | 12/2010 | Hulock et al. | |

* cited by examiner

GOLF PUTTER

BACKGROUND OF THE INVENTION

1. Field of the Invention

The present invention relates to a golf club and more particularly to a golf putter.

2. Description of the Related Art

According to the United States Golf Association (USGA)—the national governing body of golf for the U.S. and Mexico—a club is an implement designed to be used for striking a ball and generally comes in four forms: woods, irons, hybrids, and putters. The words "wood," "iron," and hybrid do not necessarily refer to the material the club is made out of, but rather to the general shape of the club head. A wood club is one where the head is relatively broad from face to back, and it can be made of materials such as titanium, steel or wood. An iron club is one where the head is relatively narrow from face to back, and it is usually made of steel. A hybrid club is a cross between a wood and an iron and is generally larger from front to back than an iron club, but smaller than a wood club. In general, a club is composed of a head and a shaft and conforms to the "plain in shape" rule of the USGA. More specifically, by definition, a putter is a club primarily designed for use on a putting green with a loft that must not exceed ten degrees; a club with a loft greater than ten degrees is normally regarded as an iron club.

In general, a putter can fall into one of two categories—traditional putter and long putter. The traditional putter usually can range in length from thirty inches to thirty-seven inches and can include a grip between ten and eleven inches in length. The long putter can range from forty inches to fifty-two inches long and can also include up to two grips, one about thirteen inches long and another about five and one half inches long. Most standard putters have a total mass of about five hundred twenty two grams.

Characteristics of an individual putter, such as length, overall mass, head mass, and head design can affect the playing characteristics of a putter, for instance, distance and accuracy, and the "feel" of a putter. For instance, the direction of a putt is dictated by the path of the club head and the face angle at impact. A ball travels farthest when the center of gravity of the club head or "sweet spot" of a putter strikes the ball as opposed to when a putt is off-center towards either the heel or toe.

Golf course improvements have lead to "faster" greens, meaning a golf ball will roll farther with any given amount of applied force. "Faster" greens require a golfer to have an increased sensitivity for better control when putting. In addition, smaller or slower strokes may be required for these "faster" greens, which increase the likelihood that a golfer may have a jerky stroke. The stroke of a golfer could also suffer from insufficient acceleration in the attempt to control the area of impact between the golf ball and the putter. A jerky stroke and insufficient acceleration can lead to directional problems. Attempts have been made to overcome these issues by redistributing the weight of a club head and by adding weight to the shaft. But these methods have not been able to provide a golfer with optimum stability and sensitivity.

BRIEF SUMMARY OF THE INVENTION

Embodiments of the present invention address deficiencies of the art in respect to golf clubs and provide a novel and non-obvious apparatus for moving the balance point of a golf club to a region within five inches up from the sole of a club head. In an embodiment of the invention, a club head comprising a body defining a volume can be provided. The golf club can further comprise a shaft comprising a tip and a butt opposite the tip, the shaft being coupled to the club head at the tip. The shaft can comprise a mass of between no less than ten grams and no more than forty nine grams. A balance point established above the sole and no further away from the sole than five inches, the five inches measured from the sole along a longitudinal axis of the shaft can further be provided.

Of note, the body can comprise a hitting face, a sole located at a bottom portion of the body, a leading edge defined by an intersection of the hitting face and the sole, a trailing edge located on the sole opposite the leading edge, a toe disposed between the leading edge and the trailing edge above the sole at a distal end of the body, and a heel disposed between the leading edge and the trailing edge above the sole at an end of the body opposite the toe.

Another embodiment of the invention provides a method for creating a club head with enhanced balanced point placement. The method can include, in a golf club form from a club head coupled to a shaft, moving a balance point from a position between no less than seven inches and no more than eighteen inches measured from the sole along a longitudinal axis of the shaft between a butt of the shaft and a sole of the club head to a position no further away from the sole than five inches measure from the sole along a longitudinal axis of the shaft.

It will be recognized by the skilled artisan that the movement of the location of a balance point away from its traditional position in the shaft to a region within five inches up from the sole of a club head, can permit club designers, for instance, putter designers, to align the balance point of a golf club significantly closer to four other balance points of a golf club: (1) horizontal face (toe to heel) balance point; (2) rear face (sole to topline) balance point; (3) balance point from the leading edge to the trailing edge; and (4) face balance. By bringing the balance point of the golf club in close alignment to the four balance points found in the club head, a "true" balance can be achieved. The "true" balance can allow all five balance points to work in unison to dynamically optimize the ability of the putter to perform with peak efficiency.

Further, the movement of the balance point of the golf club can result in a golfer experiencing club head leverage, optimum energy transfer, optimum timing of club head release, squaring of club head at ball impact, better control of swing path as well as maximum control of distance and accuracy. Of note, locating the balance point to a region within five inches up from the sole of a club head can allow a golfer to better control his swing by enabling the golfer to better "feel" the club head during a stroke. Of further note, by placing the balance point within five inches up from the sole of a club head, optimum wrist and club head release (during a stroke) can also more likely take place, creating maximum club head leverage, thus adding to the control of the travel distance of a golf ball. In addition, creating optimum wrist and club head release can further create maximum club head energy at impact with a ball, thus adding to the travel distance of a golf ball and can help prevent coming up short at a hole. The striking of the ball at the bottom of the arc, not on the up swing or down swing can also be a result of a head balanced putter.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a golf club with a balance point located within five inches from the sole of a club head, which is in-part achieved by using a light weight shaft of between about ten grams to about forty nine grams (without a grip) as opposed to about one hundred grams to one hundred twenty seven grams for a traditional shaft. Specifically, by using a light weight shaft, the balance point of a golf club can be located within a region above the sole and no further than five inches up from the sole of a club head as opposed to being located above seven inches from the sole of a club head in a traditional golf club, for instance a putter. Of note, the combination of light weight components in a golf club, including but not limited to the shaft and the club head can enable a overall balance point to be located near or at the club head. Of further note, a grip of between about four grams and about twenty five grams can also be coupled to the shaft to create a balance point within five inches from the sole of a club head. Of even further note, reference to a balance point of a golf club generally references the overall balance point of a golf club (from the sole of the club head to the top of the grip).

Figure 1A:
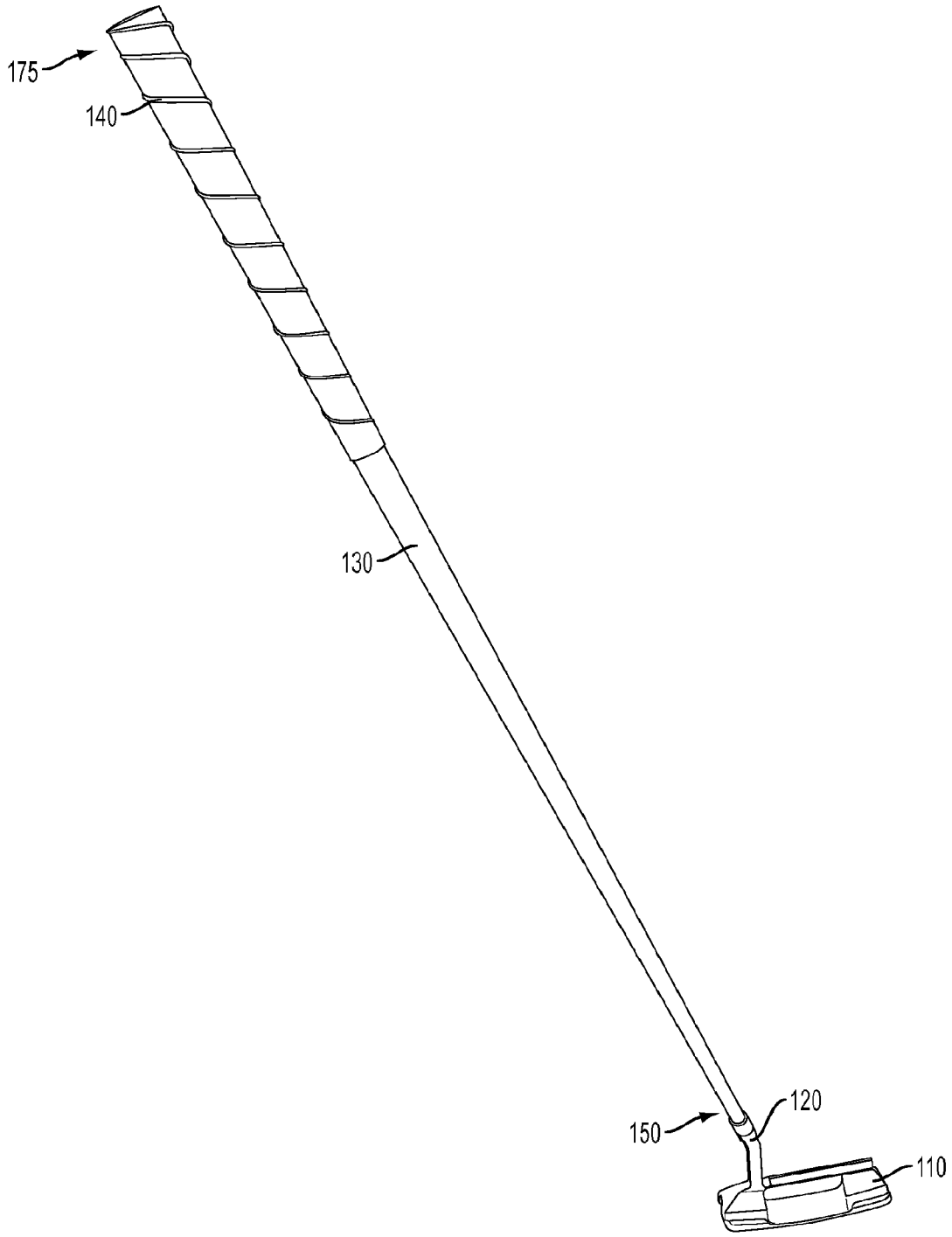
FIG. 1A is a view of a golf club in accordance with an embodiment of this invention.

In further illustration, FIG. 1A shows a view of a golf club in accordance with an embodiment of this invention. The club head 110 may or may not have a neck 120. The neck 120 must not be more than about five inches in length, which can be measured from the top of the neck 120 to the sole (of the club head 110) along the axis of the neck 120.

The club head 110 can be manufactured using any procedure now known or later developed, including but not limited to investment casting, milling, forging, sand casting, die casting, injection molding, and pressed powdered metal. In addition, the club head 110 can be manufactured from any material now known or later developed, including but not limited to stainless steel, brass, aluminum, manganese, bronze, zinc, steel, tungsten, titanium, graphite, wood, and any combination of any material. The club head 110 can be of any shape and design as to remain compliant with USGA rules. Also, the club head 110 can have a mass of between three hundred thirty grams and about three hundred seventy grams. Of note, this mass represents the standard mass for most club heads 110 used in the current manufacturing of golf clubs.

The club head 110 can be coupled to a shaft 130 at the tip 150 of the shaft 130 using any method now known or later developed, including but not limited to plugs, pins, welding, and epoxy. Of note, the shaft 130 can comprise a tip 150 and a butt 175 opposite the tip 150. The butt 175 is the larger end of a golf shaft 130; the tip end 150 is the smaller end of a golf shaft 130. Of further note, the shaft 130 can be coupled to the club head 110 at any point on the club head 110. The shaft 130 can made of any material or combination thereof now known or later developed, including but not limited to carbon, graphite, and high modulus composites. The shaft 130 (without a grip) can weigh between about ten grams and about forty nine grams. The shaft 130, in an embodiment, can be manufactured with graphite carbon fiber with a mass between about ten grams and about forty nine grams. In another embodiment, ultra high modulus materials, such as graphite nano tubes can be used.

The shaft 130 can be manufactured by any process now known or later developed, including but not limited to sheet rolling, table rolling, filament winding, and resin transfer molding. The shaft 130 can be manufactured to any size and shape. For instance, for a putter, the length of the shaft 130 is between about eighteen inches to about thirty seven inches (as manufactured and/or pre-cut). Of further note, in an embodiment, the overall length of a golf club, such as a putter, can be about thirty five inches. Of even further note, the shaft 130 can have a butt 175 of about half an inch to approximately one inch in diameter that is gradually tapered from the butt 175 towards the smaller tip 150. In another embodiment, the diameter of the shaft 130 at the butt 175 can be greater than one inch. The tip 150 can have a diameter of less than about four tenth inches. In addition, the shaft 130 can have parallel and tapered sections.

Coupled to the butt 175 of the shaft 130 can be a grip 140, comprising a mass between about four grams and no more than twenty-five grams. The grip 140 can be made from any material or combination thereof, now known or later developed, including rubber, kraton, cork, polyurethane, composites, including polyurethane and thin leather. In one instance, the grip 140 can be a tennis style wrap with an average mass of between about four grams and about twenty-five grams, preferably between about four grams and about thirteen grams, and can be between about one and two millimeters thick or greater. Of note, in an embodiment, the butt 175 of the shaft 130 can be about one to two millimeters less than the minimum size of grip 140 that will be coupled to the shaft 130. In other words, in most instances, the net finished size of the butt 175 of the shaft 130 will be about one or two millimeters less than that of the finished grip size. The grip 140 can be applied to the shaft 130 at the butt 175 by any method now known or later developed, including but not limited to slip-on and wrap-on. In addition, the grip 140 can be secured to the shaft 130 by any method now known or later developed, including but not limited to pressure wrapping, tape, cement, and glue. The length of the grip 140 is not specifically defined, but can be of any length. For instance, the length of the grip 140 can range up to about thirteen inches long. Of note, it is possible to have a partial grip or no grip.

Of note, the grip 140 of a putter can have a non-circular cross section. For instance, the grip 140 can be D, oblong, or irregularly shaped, where one side of the grip 140 is flat. This D, oblong, or irregularly shape can be formed by any method now known or later developed, including inserting a flat piece of material, such as cork, plastic, graphite, or any material now known or later developed, and wrapping the grip 140 around the material and the shaft 130. This flat or any other additions to the shaft 130 to create a grip 140 may also be connected to a butt cap or cover (not shown) that will integrate and cover the butt of the shaft 130 as well as create a shape or underlisting that a grip 140 may be applied to. The underlisting can be a form placed on the butt 175 of a shaft 130 which can serve as the foundation for the shape and size of a grip 140. The butt cap may or may not also be used to reinforce the structural integrity of the butt 175 of the shaft 130. Of note, the additional use of an underlisting may depend on the process used to manufacture the shaft 130. For example, if the shaft 130 is manufactured with either filament winding or resin transfer molding, the D, oblong, or irregular shape can be fabricated into the shaft 130, but if table rolling is used, a separate piece will have to be bonded to achieve a D, oblong, or irregular shape. It is also possible to incorporate a neck portion 120 of the head 110 as a part of the shaft 130. The neck 120 can be the portion of the club head 110 that receives the shaft 130. In one instance, the neck 120 can molded as a separate component of the club head 110, which can be connected to the body 105 of a club head 110 via any method now known or later developed, including glue and welding. In another embodiment, a club head 110 with a neck 120 can be manufactured as one piece; the neck 120 can still be connected to the body 105 of the club head 110. Of note, a neck 120 is not required; the shaft 130 can be coupled to a club head 110.

The combination of the shaft 130, head 110 (including the neck 120), and grip 140 can comprise an approximate mass between about three hundred seventy and about four hundred sixty gram. Of note, this mass can include items required for assembly, such as, but not limited to pins, glue, and tape.

Figure 1B:
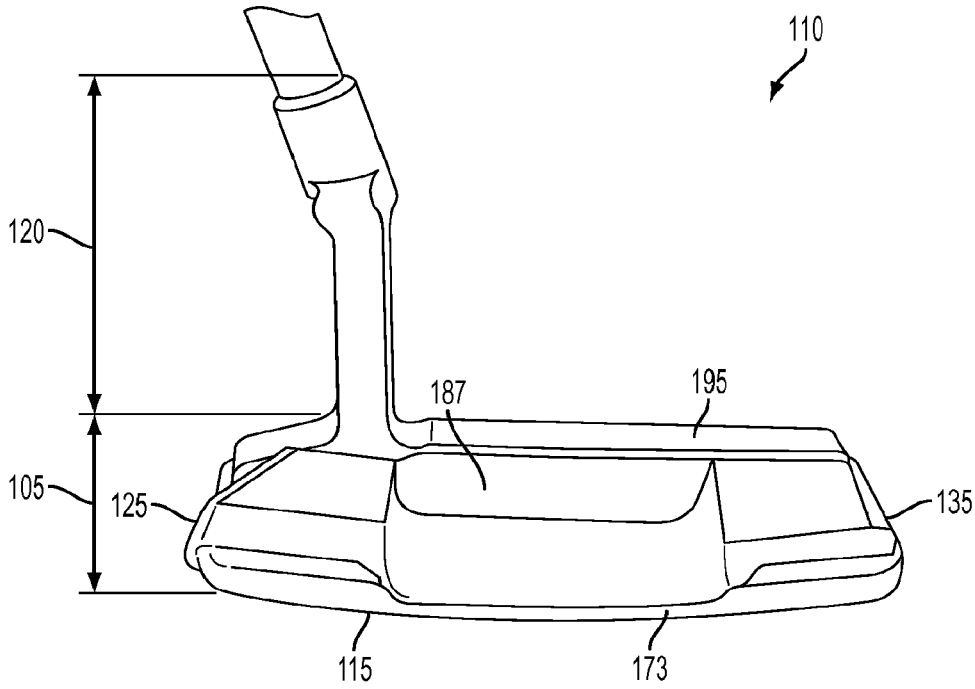
FIG. 1B is a view of the back of a club head in accordance with an embodiment of this invention.

In further illustration, FIG. 1B is a view of the back of a club head 110 in accordance with an embodiment of this invention. A club head 110 can comprise a neck 120 and a body 105. The body 105 can define a volume comprising a rear face 187. The rear face 187 can be opposite a hitting face, the hitting face can be the face of a club head 110 that makes contact with a golf ball. Of note, in an embodiment, the rear face 187 can be approximately vertical. The top edge of the body 105 is the topline 195; it is generally where the face (rear 187 or hitting) and back meet. The body 105 can further comprise a sole 115, which is located at a bottom portion of the body 105; it is the portion of a club head 110 that touches the ground.

The body 105 can additional include a toe 135 and a heel 125. The toe 135 can be disposed between the leading edge and the trailing edge 173 above the sole 115 at a distal end of the body 105. The toe 135 can refer to the outward point of a club head 110 when it is held in hitting position; it is the point on the club head 110 furthest from a golfer. The heel 125 can be disposed between the leading edge and the trailing edge 173 above the sole 115 at an end of the body 105 opposite the toe 135. Of note, the heel 125 is the portion of a club head 110 closest to a golfer when the club is held in a hitting position.

Figure 1C:
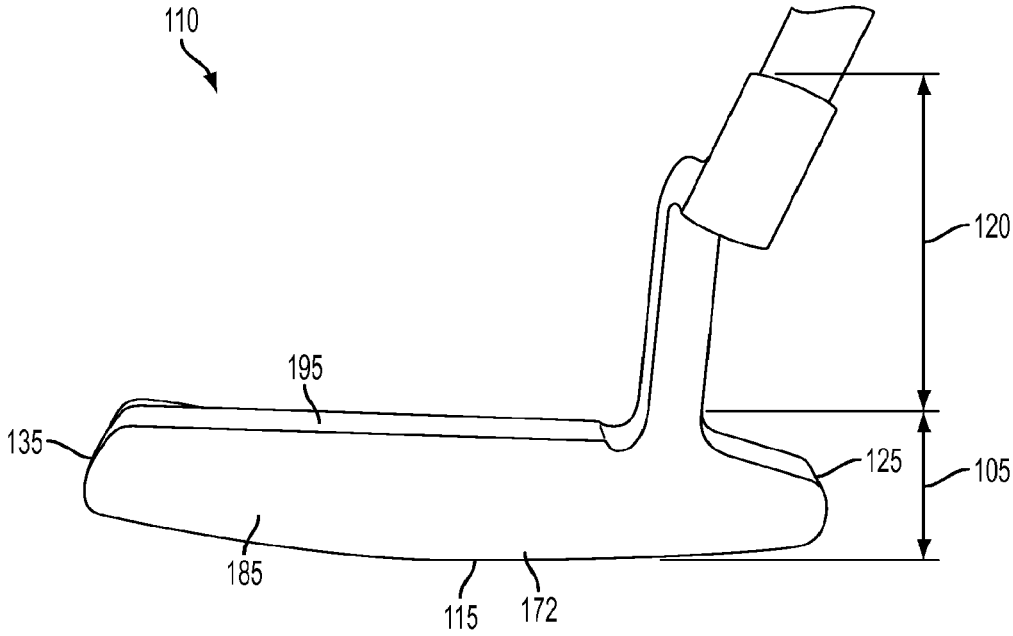
FIG. 1C is a view of a club head showing a hitting face in accordance with an embodiment of this invention.

In further illustration, FIG. 1C is a view of club head 110 showing a hitting face 185 in accordance with an embodiment of this invention. A club head 110 can comprise a neck 120 and a body 105. The body 105 can comprise a hitting face 187. The hitting face 187 is the face of a club head 110 that makes contact with a golf ball. Of note, the top edge of the face (hitting 185 or rear) can usually form the topline 195 of the club head 110; the topline 195 is the top edge of the body 105. The body 105 can further comprise a leading edge 172 defined by an intersection of the hitting face 185 and the sole 115. The leading edge 172 is the edge that leads the swing. The body 105 can further have a toe 135 and a heel 125.

Figure 2:
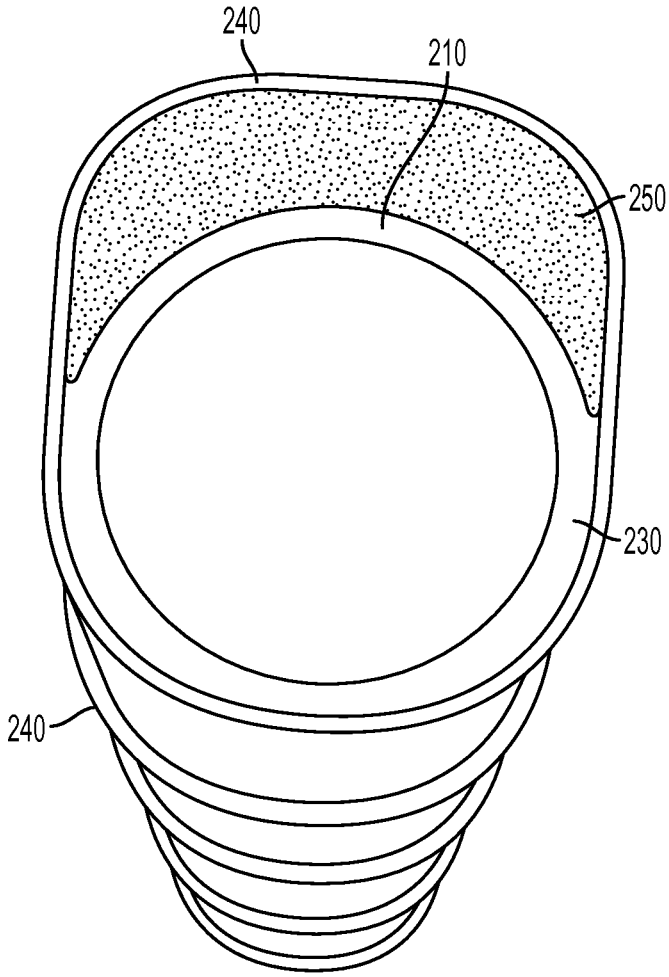
FIG. 2 is a cut-away view of the D-shaped grip end of a putter in an embodiment of this invention.

In further illustration, FIG. 2 is cut-away view of the D-shaped grip end of a putter in an embodiment of this invention. Of note, a putter is generally manufactured to include a flat spot or side or some other special shape to it, which can allow the hands of a golfer to lock and square the putter face in the same manner each time. In an embodiment, a filler 250 can be coupled to the shaft 230 with a shaft wall 210; grip 240 can then be wrapped around both the filler 250 and the shaft 230 to produce at least one flat-side or D, oblong, or irregular shaped grip 240 on the butt end of the putter. Of note, in one embodiment, the shaft wall 210 can be twice as thick as the thickness of the grip 240. The length of the grip 240 having the D, oblong or irregular shape is not limited to a specific length. In one instance, the grip length can be between about ten inches and about thirteen inches in length. The filler 250 can be any material now known or later developed, including but not limited to cork, plastic, and graphite. In another instance, a flat piece of material can be coupled to the shaft 230 and the grip 240 to create the D, oblong, or irregular shape; the type of material used is not limited, but it can cork, plastic, graphite, carbon, wood or any material now known or later developed. Optionally, padding can be placed between the flat piece of material and the shaft 230. The padding can be made of any material, including but not limited to cork, graphite, tar, polypropylene, polyurethane, foam (of any kind) and others either now known or later developed.

Figure 3A:
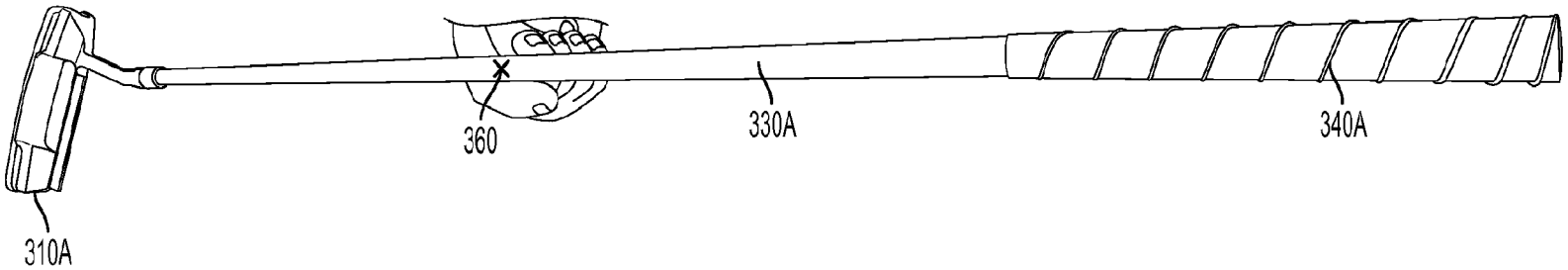
FIG. 3A is a view of a prior art golf club showing a balance point of a golf club.

FIG. 3A is a view of a prior art golf club showing a balance point 360 of a golf club in an embodiment of this invention. A club head 310A can be coupled to a shaft 330A, which can have a grip 340A. A balance point of the golf club 360 can be located on the shaft 330A. The balance point 360 in a prior art golf club, for instance in a putter, can be centered at a midpoint between the sole of the club head 310A and the butt of the shaft 330A, which is usually seven inches to eighteen inches (or higher) above the sole of the club head 310A.

Figure 3B:
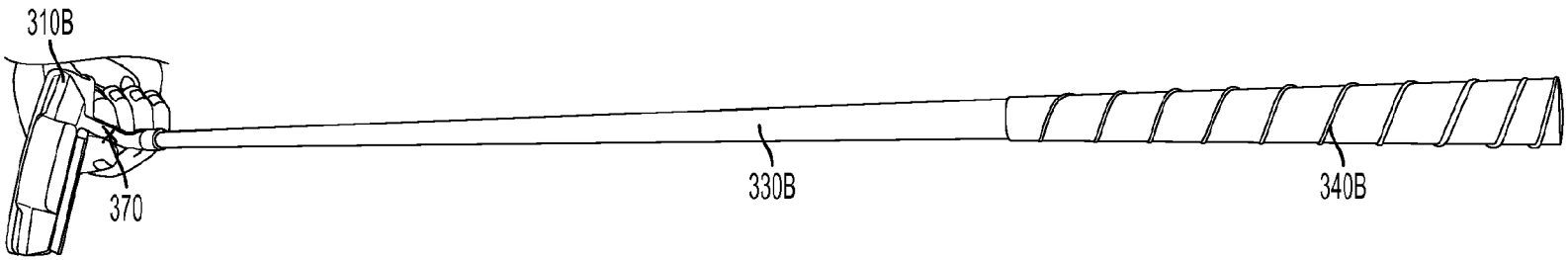
FIG. 3B is a view of a golf club showing a balance point of a golf club in an embodiment of this invention

FIG. 3B is view of a golf club showing a balance point of a golf club 370 in an embodiment of this invention. The golf club with a balance point 370 can be located anywhere within five inches up from the sole of a club head 310B, regardless of whether the golf club does or does not have a neck. In other words, the balance point 370 can be established above the sole and no further away from the sole than five inches, the five inches measured from the sole along a longitudinal axis of the shaft 330B. In this way, a club head 310B can be created with enhanced balance point placement, by moving a balance point 360 from a position centered between no less than seven inches and no more than eighteen inches measured from the sole along a longitudinal axis of the shaft 330A between a butt of the shaft 330A and a sole of the club head 310A to a position no further away from the sole than five inches measured from the sole along a longitudinal axis of the shaft 330B, for a golf club formed from a club head 310B coupled to a shaft 330B.

Of note, the center of gravity or balance point of a golf club 370 as well as the mass of the shaft 330B, the grip 340B, and the head 310B can affect the overall swingweight of a club as well as the speed, accuracy, and distance a golfer can hit a ball. Design features of the head 310B, such as lightening the neck with holes and making the neck from lighter materials, can further lower the balance point of the golf club 370. Of note, the neck can be made from any material now known or later developed, including graphite, carbon, and composites.

Of further note, a putter with a balance point of approximately five inches from the sole of a club head 310B can have an approximate mass of four hundred sixty six grams, which is the approximate total mass of a grip 340B, a shaft 330B, and a head 310B. Of further note, a putter with a balance point 370 of five inches from the sole of a head 310B having a total mass of about four hundred sixty six grams can have a head 310B that weighs about three hundred sixty grams with the combination of a grip 340B and shaft 330B weighing about one hundred six grams, where the club length can be about thirty-five inches. A putter having a balance point 370 of approximately four inches from the sole of a head 310B can have an approximate mass of four hundred thirty six grams, which is the approximate total mass of a grip 340B, a shaft 330B, and a head 310B, where the club length is about thirty five inches. A putter having a balance point 370 of approximately three inches from the sole of a head 310B can have an approximate mass of four hundred six grams, which is the approximate total mass of a grip 340B, a shaft 330B, and a head 310B, where the club length is about thirty five inches. A putter having a balance point 370 of approximately two inches from the sole of a head 310B can have an approximate mass of three hundred seventy six grams, which is the approximate total mass of a grip 340B, a shaft 330B, and a head 310B, where the club length is about thirty five inches. A putter having a balance point 370 of approximately one inch from the sole of a head 310B, or at the head, 310B will have the shaft 330B and grip 340B at their lightest weights, and virtually no weight in the neck. Of note, the overall length may be less than thirty five inches in this instance.

Figure 4A:
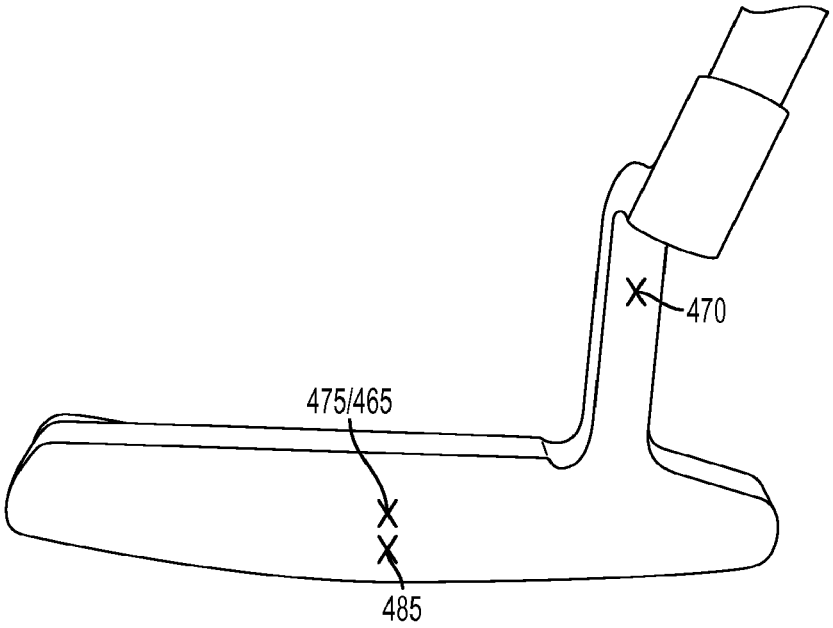
FIG. 4A is a view of a hitting face of a club head showing several balance points; and, FIG. 4B is a view of a back of a club head showing a balance point in an embodiment of the invention.

In further illustration, FIG. 4A shows a view of a hitting face illustrating several balance points, including a balance point of a golf club 470. The balance point 470 can be established above the sole and no further away from the sole than five inches, the five inches measured from the sole along a longitudinal axis of the shaft. A face balance point 475 is also located on the hitting face of the club head. Of note, face balance can refer to when a club is at rest on a typical counter height surface with the head portion of the club extending several inches beyond said counter, the club head face will balance in a horizontal position. Of further note, both the horizontal and vertical centers of gravity are both centered at the face balance point 475. Located at approximately the same location as the face balance point 475, a toe to heel or horizontal face balance point 465 can also be located on the hitting face. An additional balance point can include a sole to topline or rear face balance point 485. The topline can be the top edge of the body; it is generally the place where the face (rear or hitting) and the back meet.

Figure 4B:
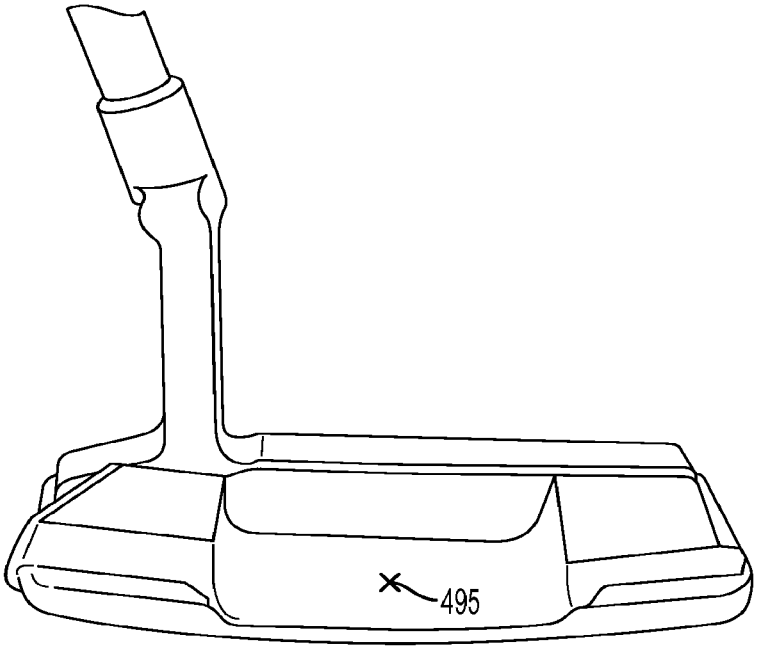

In further illustration, FIG. 4B shows the back of a club head illustrating a balance point in an embodiment of this invention, including a leading/trailing edge balance point 495 Of note, by closely aligning the different balance points of a golf club, a golfer can gain better control of the swing path of the club, better head control, better energy transfer at impact due to club head release, and better squaring of the club head at the bottom of the arc, which can result in improvements with distance and accuracy.

Of note, the golf club disclosed herein is intended to be compliant with any USGA rules governing or affecting golf club design and manufacturing. Of further note, any aspect of golf club design or manufacture not specifically referenced is assumed to be accomplished according to any common practice or standard or any method now known or later developed so as to be compliant with USGA rules or any golf governing body effecting club design and manufacturing.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A golf club comprising:

a club head comprising a body defining a volume, the body comprising:

a hitting face;

a sole located at a bottom portion of the body;

a leading edge defined by an intersection of the hitting face and the sole;

a trailing edge located on the sole opposite the leading edge;

a toe disposed between the leading edge and the trailing edge above the sole at a distal end of the body; and, a heel disposed between the leading edge and the trailing edge above the sole at an end of the body opposite the toe;

a shaft comprising a tip and a butt opposite the tip, the shaft being coupled to the club head at the tip, the shaft comprising a mass of between no less than ten grams and no more than forty nine grams; and, a balance point established above the sole and no further away from the sole than five inches, the five inches measured from the sole along a longitudinal axis of the shaft.

2. The golf club of claim 1, further comprising a grip coupled to the butt of the shaft, the grip comprising a mass of no less than four grams and no more than twenty-five grams.

3. The golf club of claim 2, wherein the combination of the shaft, the grip, and the club head comprises a mass of no less than three hundred seventy grams and no more than four hundred sixty six grams.

4. The golf club of claim 1, wherein the club head has a mass of no less than about three hundred thirty grams and no more than about three hundred seventy grams.

5. The golf club of claim 1, wherein the club head further comprises a neck, the neck connected to the body of the club head.

* * * * *